US005857796A

United States Patent [19]

Waldmann

[11] Patent Number: 5,857,796

[45] Date of Patent: Jan. 12, 1999

[54] APPLICATOR WITH RESERVOIR

[76] Inventor: Douglas G. Waldmann, 8210 Western Way, Pensacola, Fla. 32526

[21] Appl. No.: 697,580

[22] Filed: Aug. 27, 1996

[51] Int. Cl.[6] ..... A46B 11/00; B05C 17/025; A47L 13/17

[52] U.S. Cl. ..... 401/277; 401/205; 401/208; 401/219; 401/288

[58] Field of Search ..... 401/277, 208, 401/205, 219, 288; 222/499

[56] References Cited

U.S. PATENT DOCUMENTS

| | | | |
|---|---|---|---|
| 176,044 | 4/1876 | Parks | 401/146 |
| 519,223 | 5/1894 | Bailey | 401/277 |
| 585,447 | 6/1897 | Norlin | 401/184 |
| 768,504 | 8/1904 | Bagby | 401/208 |
| 1,353,625 | 9/1920 | Brandenburg | 401/184 |
| 1,412,958 | 4/1922 | Pearlmutter | 401/184 |
| 1,413,311 | 4/1922 | Auld | 401/277 |
| 2,164,009 | 6/1939 | Wright | 401/277 |
| 2,669,740 | 2/1954 | Main | 401/277 |
| 3,216,630 | 11/1965 | Stull | 401/277 X |
| 3,603,694 | 9/1971 | Hamn | 401/150 |
| 3,633,234 | 1/1972 | Henningson | 15/114 |
| 3,896,822 | 7/1975 | Zimmerman | 401/277 X |
| 3,906,573 | 9/1975 | Crawford | 15/22 |
| 4,150,904 | 4/1979 | Stewart | 401/186 |
| 4,279,527 | 7/1981 | Moe et al. | 401/277 |
| 4,424,918 | 1/1984 | Stull | 222/499 X |
| 4,748,990 | 6/1988 | Brown et al. | 401/277 X |
| 4,790,679 | 12/1988 | Murphy | 401/146 |
| 4,909,265 | 3/1990 | Goncalves | 401/277 X |
| 5,071,278 | 12/1991 | Chen | 401/146 |

FOREIGN PATENT DOCUMENTS

| | | |
|---|---|---|
| 1324774 | 6/1962 | France . |

*Primary Examiner*—Steven A. Bratlie
*Attorney, Agent, or Firm*—Peter Loffler

[57] ABSTRACT

An applicator with reservoir is comprised of a reservoir having an open top and a flow cap threadably secured thereto. A closure valve snap fits onto the flow cap and thereafter threadably rotates about the flow cap between a closed and an open position. An applicator cap, having an applicator tip, such as a brush, a roller, or the like, is threadably secured to the closure valve. In a normally open position, the closure valve permits a fluid flow path between the reservoir and the applicator tip. In a normally closed position, the closure valve interrupts the fluid flow path.

20 Claims, 3 Drawing Sheets

APPLICATOR WITH RESERVOIR

BACKGROUND OF THE INVENTION

1. Field of the Invention

The present invention relates to a fluid applicator with a supplemental reservoir.

2. Background of the Prior Art

In normal applications, paint brushes and the like are dipped into a selected liquid and thereafter the appropriate surface is brushed. After a couple of strokes the brush is redipped and the process is repeated. Such a method is not without its drawbacks.

The act of dipping and brushing is relatively slow. A dip in the liquid gives the brusher at most three or four strokes before redipping is required. This will require a multitude of liquid dipping in order to complete even a simple application job. Such a method produces a application stroke that is initially liquid rich and thick and then becomes more faint as more of the liquid is transferred from the brush to the surface.

Each time the brush is dipped, it is transferred from the application surface to the liquid container, dipped, then transferred back to the application surface. The liquid on the end of the brush can drip off and contaminate a delicate surface. Furthermore, by constantly requiring an open container of paint or other liquid, the potential of knocking the container over is a constant problem.

In order to overcome the above-mentioned shortcomings, a paint brush with a supplemental reservoir has been devised as exemplified in U.S. Pat. No. 3,633,234 to Henningsen. This device has a reservoir integral with the paint brush in order to feed paint to the bristles and keep them constantly moist. This eliminates the need for frequent dipping of the brush into the liquid container and eliminates the need to have an open liquid container.

Although this device works relatively well, it has certain shortcomings. Adequate control of liquid flow rate from reservoir to bristles is not possible. Such control is especially desirable when using a detail brush to perform delicate work. Furthermore, the device is suited only for bristle-tipped brushes. It cannot be used with non-bristle application tips.

Therefore a need in the art exists for a liquid applicator with a reservoir that can control the liquid flow rate and can be used with a variety of applicator tips. Ideally, such a device will have closure means for transfer between jobs, and will be simple and straightforward to use.

SUMMARY OF THE INVENTION

The applicator with reservoir of the present invention addresses the aforementioned needs in the art. The applicator with reservoir is comprised of a reservoir having a threaded open top. A flow cap, having a fluid chamber therein, is threadably securable to the reservoir. A plug, seated on a plurality of prongs extends from the top of the flow cap and forms a plurality of fluid openings therebetween. A closure valve snap fits onto the flow cap and is thereafter free to threadably rotate about the flow cap between a normally closed and a normally open position. An applicator cap, having a fluid reservoir and an applicator tip connected by a duct, is threadably securable to the closure valve. The applicator tip can be of any appropriate design including a brush, a sponge tip, a stylus tip, a roller tip, as well as many others.

In a normally closed position, the plug is received within the fluid reservoir of the applicator cap and prevents fluid flow therepast. Rotation of the closure valve causes the closure valve and attached applicator cap to rise relative to the flow cap, thereby withdrawing the plug from the fluid reservoir establishing a fluid flow path from the reservoir to the applicator tip. Interacting ridges on the flow cap and the closure valve prevent closure valve separation from the flow cap. Counterrotation of the closure valve causes the plug to be reinserted into the fluid reservoir of the applicator cap, interrupting fluid flow between the reservoir and the applicator tip.

The fluid to be applied remains within the device itself, thereby eliminating the need to dip and brush. This allows the user to complete a given application job more quickly and without creating a mess. The fear of an open liquid container is eliminated. The reservoir, by being resilient, allows a user to squeeze the reservoir in order to force liquid to the applicator tip. This permits the user to control the amount of liquid available at the applicator tip and thus the thickness of the liquid streak that is applied. By having a multitude of interchangeable applicator tips, the device is very versatile. The device is easy and straightforward to use and is simple in design and construction.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 3:
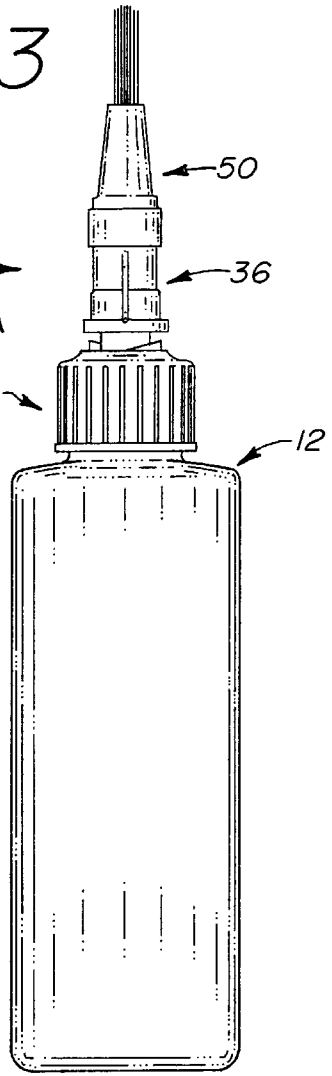
FIG. 3 is a front elevation view of the applicator with reservoir in an open position.
Figure 2:
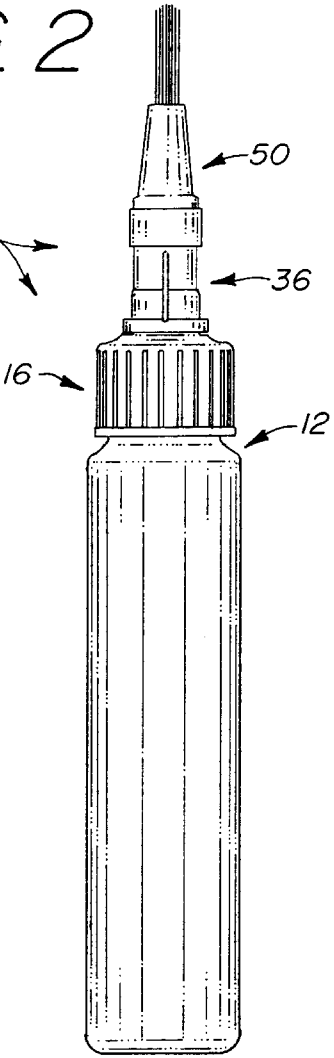
FIG. 2 is a rotated view of FIG. 1.
Figure 1:
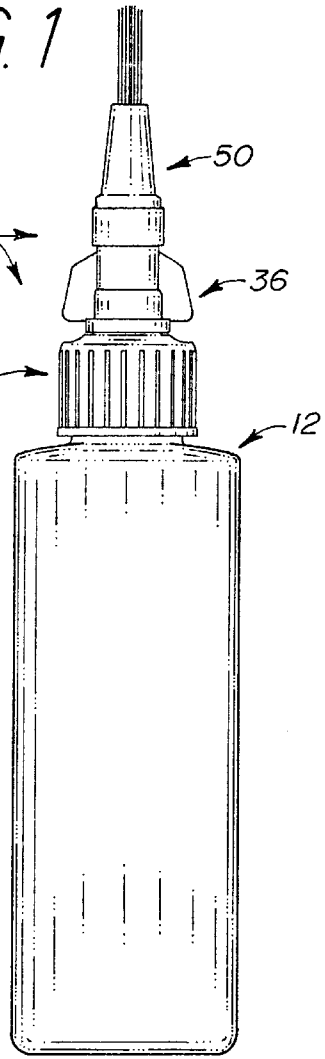
FIG. 1 is a front elevation view of the applicator with reservoir of the present invention in a closed position.
Figure 4:
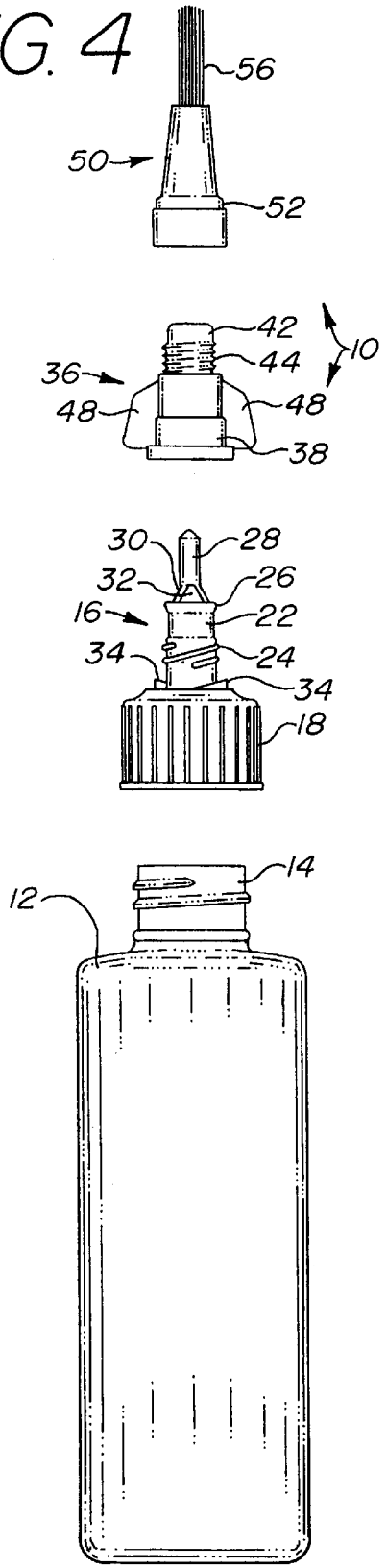
FIG. 4 is an exploded view of the applicator with reservoir.

Referring now to the drawings, it is seen that the applicator with reservoir, generally denoted by reference numeral 10, is comprised of a reservoir 12 having an open top 14 that is threaded. The reservoir 12 can be of any appropriate shape and size, and is, advantageously, made from a generally resilient material. Volumetric level gradations can be printed on the reservoir 12.

A flow cap 16, having a base 18 with female threading 20 and a hollow shaft 22 with male threading 24 is threadably securable to the top 14 of the reservoir 12. If desired, the outer surface of the base 18 can be knurled. The top of the shaft 22 is open and has a first ridge 26 encompassing the outer periphery of the top. A fluid plug 28 is positioned above the top of the shaft 22 on three prongs 30. The prongs 30 and the fluid plug 28 form a trio of fluid openings 32. A pair of stop tabs 34 are located on the top of the base 18.

A hollow closure valve 36, having a base 38 with female threading 40, a shaft 42 with male threading 44, and a second ridge 46 encompassing the inner circumference of the base 38 above the female threading 40, is positionable over and snap fit onto the flow cap 16. Once snap fit into place, the female threading 40 of the closure valve 36 mates with the male threading 24 of the flow cap 16 permitting the closure valve 36 to rotate between an open and a closed position. A pair of winglets 48 extend outwardly from the base in order to facilitate user grip of the closure valve 36.

An applicator cap 50, having a base 52 with female threading 54, is threadably securable to the shaft 42 of the closure valve 36. An applicator tip, such as a set of bristles 56, a sponge tip 58, a stylus tip 60, a roller tip 62, or a curved applicator tip assembly 64, is secured to the top of the applicator cap 50.

A fluid reservoir 66 is a located within the applicator cap 50, while a fluid duct 68 fluid connects the fluid reservoir 66 with the applicator tip.

The sponge tip 58 comprises a folded porous foam brush 70. The stylus tip 60 comprises a body member 72 with a rounded stylus end 74, and a weep hole 76, in fluid communication with the duct 68, on the side of the body member 72. Fluid flows from the duct 68 out through the weep hole 76, where, through surface tension, the fluid travels from the weep hole 76, down the outer surface of the body member 72 to the rounded stylus end 74 and is applied to the work surface by the rounded stylus end 74. The roller tip 62 comprises a roller wheel 78, made from a porous material such as foam or felt, rotatably attached to the end of the applicator cap 50. Liquid exits from the open top of the applicator cap 50 and contacts the roller wheel 78 causing the roller wheel 78 to absorb the incoming liquid. As the roller wheel 78 is rolled across a work surface, liquid is transferred from the roller wheel 78 to the work surface. The roller wheel 78 has a taper or bevel 80 on either end. Pressing lightly onto the work surface with the roller tip 62 will cause a small portion of the roller wheel 78 to be in contact with the work surface producing a relatively narrow line as the roller wheel 78 is rolled across a work surface. Pressing harder onto the work surface with the roller tip 62 will cause the roller wheel 78 to slightly deform, thereby causing a larger portion of the roller wheel 78 to be in contact with the work surface producing a relatively wide line.

Figure 5:
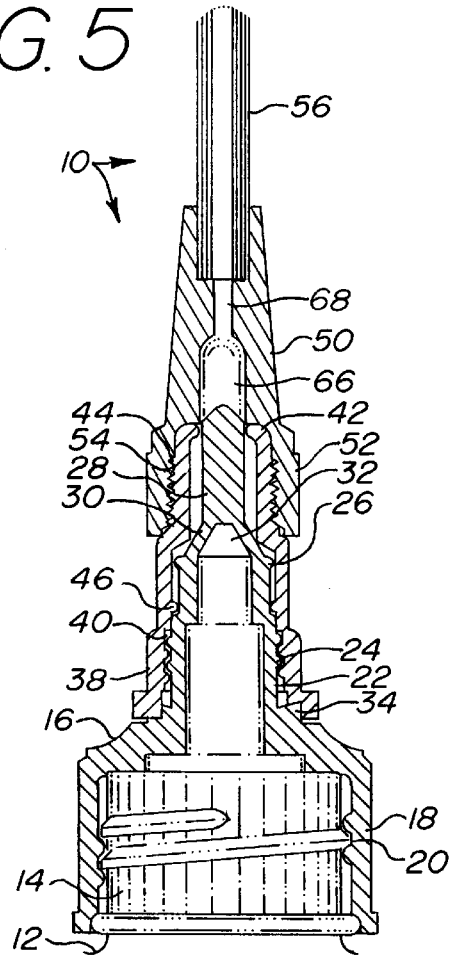
FIG. 5 is a cutaway view of the applicator closure means in a closed position.
Figure 6:
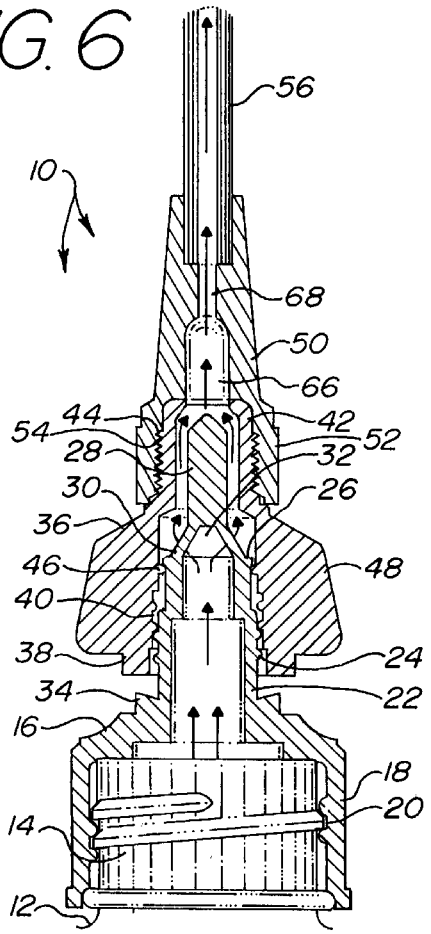
FIG. 6 is a cutaway view of the applicator closure means in an open position illustrating the fluid flow path.
Figure 7A:
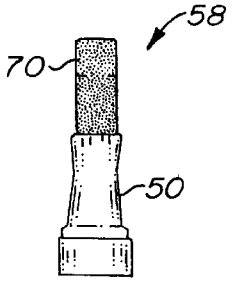
FIG. 7*a* is an elevation view of the sponge tip.
Figure 7B:
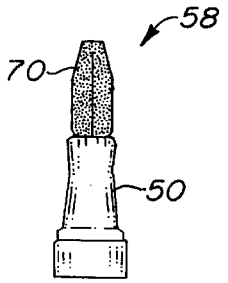
FIG. 7*b* is a rotated view of FIG. 7*a*.
Figure 7D:
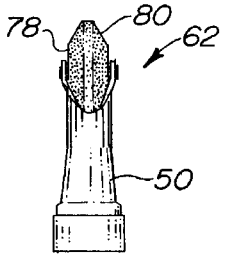
FIG. 7*d* an elevation view of the roller tip.
Figure 7E:
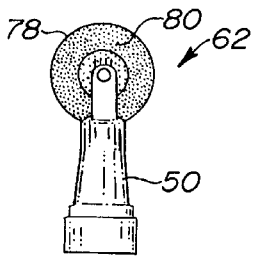
FIG. 7*e* is a rotated view of FIG. 7*d*.
Figure 7F:
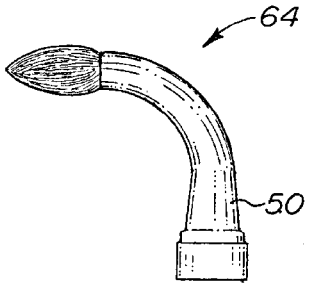
FIG. 7*f* is an elevation view of the curved applicator tip assembly.
Figure 7C:
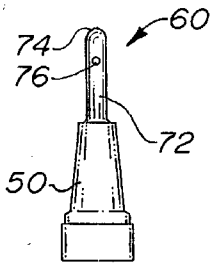
FIG. 7*c* is an elevation view of the stylus tip.

In order to utilize the applicator with reservoir 10, the reservoir 12 is filled with a desired liquid, the flow cap 16 is threadably secured to the top 14 of the reservoir 12, the closure valve 36 is snap fit to the top of the flow cap 16 and an applicator cap 50, with a desired applicator tip, is threadably secured to the top of the closure valve 36. With the closure valve 36 fully tightened onto the flow cap 16, the device 10 is in a closed position. The winglets 48 each abut a stop tab 34 on the flow cap 16 in order to prevent over-tightening of the closure valve 36. As seen in FIG. 5, in this closed position, the plug 28 is received within the fluid reservoir 66 and restricts any fluid flow therepast.

In order to open the device 10, the closure valve 36 is rotated about the flow cap 16. The first ridge 26 of the flow cap 16 interacts with the second ridge 46 of the closure valve 36 in order to assure that the closure valve 36 does not separate from the flow cap 16 (through overrotation), during rotation of the closure valve 36. In this position, the plug 28 is withdrawn from the fluid reservoir 66 establishing a fluid flow path between the reservoir 12 and the applicator tip. Specifically, fluid flows from the reservoir 12, through the fluid chambers of the flow cap 16, out through the fluid openings 32, through the fluid chamber delimited by the inner surface of the closure valve 36 and the plug 28, through the fluid reservoir 66, through the fluid duct 68 and to the applicator tip wherein the fluid is applied to a work surface as desired. A gentle squeeze onto the sides of the reservoir 12 will inject more fluid to the applicator tip. Upon completion of the application job, the closure valve 36 is counter-rotated, thereby closing the device 10.

Device cleaning is straightforward. The applicator cap 50 is threadably removed from the closure valve 36, and is cleaned or changed. With a gentle pull, the closure valve 36 is snapped off from the flow cap 16. The flow cap 16 is threadably unsecured from the reservoir 12.

While the invention has been particularly shown and described with reference to an embodiment thereof, it will be appreciated by those skilled in the art that various changes in form and detail may be made without departing from the spirit and scope of the invention.

I claim:

1. An applicator with reservoir comprising:

a first fluid reservoir having a closed bottom and a first open top;

a first shaft having an open bottom and a top for receiving the applicator tip;

a second fluid reservoir located intermediate the open bottom and the top;

a duct connecting the second fluid reservoir and the top;

a cap, having a first open base and a second shaft with first male threading on the second shaft's outer surface and a second open top, threadably attached to the first open top of the first fluid reservoir;

a plurality of prongs extending upwardly from the second open top;

a plug situated atop the plurality of prongs in spaced apart relation to the second top;

a closure valve, having a second open base with female threading on the second base's inner surface and a third shaft with second male threading on its outer surface for threadably receiving the open bottom, removably securable to the cap such that the first male threading mates with the female threading and permits rotation of the closure valve about the cap such that rotation of the closure valve lowers the closure valve toward the cap and the plug is received within the second fluid reservoir for disrupting fluid communication between the first fluid reservoir and the applicator tip and such that counterrotation of the closure valve raises the closure valve away from the cap and withdraws the plug from the second fluid reservoir and permits fluid communication between the first reservoir and the applicator tip.

2. The device as in claim 1 further comprising a plurality of winglets extending outwardly from the second base.

3. The device as in claim 2 further comprising a plurality of stop tabs, located on the first base, for interacting with the winglets and preventing overrotation of the closure valve.

4. The device as in claim 1 further comprising:

a first ridge encompassing the second shaft proximate the open top; and a second ridge encompassing the second base for interacting with the first ridge and preventing overcounterrotation of the closure valve.

5. The device as in claim 1 wherein the first open base is knurled.

6. The device as in claim 1 wherein the applicator tip is a set of bristles.

7. The device as in claim 1 wherein the applicator tip is a sponge tip.

8. The device as in claim 1 wherein the applicator tip is a stylus tip.

9. The device as in claim 1 wherein the applicator tip is a curved applicator tip assembly.

10. The device as in claim 1 wherein the applicator tip is a roller tip.

11. The device as in claim 10 wherein the roller tip is beveled.

12. The device as in claim 1 wherein the first fluid reservoir is resilient.

13. An applicator with reservoir consisting essentially of:

a first fluid reservoir having a closed bottom and a first open top;

a first shaft having an open bottom and a top for receiving the applicator tip;

a second fluid reservoir located intermediate the open bottom and the top;

a duct connecting the second fluid reservoir and the top;

a cap, having a first open base and a second shaft, the second shaft having a first section with a first diameter and a second section with a second diameter that is different than the first diameter, with first male threading on the second shaft's outer surface and a second open top, threadably attached to the first open top of the first fluid reservoir;

a plurality of prongs extending upwardly from the second open top;

a plug situated atop the plurality of prongs in spaced apart relation to the second top;

a closure valve, having a second open base with female threading on the second base's inner surface and a third shaft with second male threading on its outer surface for threadably receiving the open bottom, removably securable to the cap such that the first male threading mates with the female threading and permits rotation of the closure valve about the cap such that rotation of the closure valve lowers the closure valve toward the cap and the plug is received within the second fluid reservoir for disrupting fluid communication between the first fluid reservoir and the applicator tip and such that counterrotation of the closure valve raises the closure valve away from the cap and withdraws the plug from the second fluid reservoir and permits fluid communication between the first reservoir and the applicator tip.

14. The device as in claim 13 further further consisting of a plurality of winglets extending outwardly from the second base.

15. The device as in claim 14 further further consisting of a plurality of stop tabs, located on the first base, for interacting with the winglets and preventing overrotation of the closure valve.

16. The device as in claim 13 further further consisting of:

a first ridge encompassing the second shaft proximate the open top; and a second ridge encompassing the second base for interacting with the first ridge and preventing overcounterrotation of the closure valve.

17. The device as in claim 13 wherein the first open base is knurled.

18. The device as in claim 13 wherein the applicator tip is a set of bristles.

19. The device as in claim 13 wherein the applicator tip is a sponge tip.

20. The device as in claim 13 wherein the applicator tip is a stylus tip.

* * * * *